US005948736A

United States Patent [19]

Smith et al.

[11] Patent Number: 5,948,736

[45] Date of Patent: Sep. 7, 1999

[54] DUST FREE LITHIUM HYDROXIDE

[75] Inventors: W. Novis Smith; Joel McCloskey, both of Philadelphia, Pa.

[73] Assignee: Toxco, Inc., Anaheim, Calif.

[21] Appl. No.: 09/139,191

[22] Filed: Aug. 25, 1998

[51] Int. Cl.[6] ..... C10M 113/16

[52] U.S. Cl. ..... 508/178

[58] Field of Search ..... 508/178

[56] References Cited

U.S. PATENT DOCUMENTS

| | | | |
|---|---|---|---|
| 2,532,201 | 11/1950 | Sprague . | |
| 2,639,221 | 5/1953 | Henn | 23/184 |
| 2,649,376 | 8/1953 | Rasch et al. | 95/88 |
| 2,755,247 | 7/1956 | Dilworth et al. | 508/178 |
| 2,846,308 | 8/1958 | Baxendale | 96/66 |
| 2,883,342 | 4/1959 | Sproule et al. | 508/178 |
| 2,983,680 | 5/1961 | Eckert et al. | 508/178 |
| 3,388,065 | 6/1968 | Haimbaugh | 508/178 |

*Primary Examiner*—Jerry D. Johnson
*Attorney, Agent, or Firm*—John Lezdey & Assoc

[57] ABSTRACT

The present invention provides a method for forming dust free lithium hydroxide monohydrate. The method contains the step of coating the lithium hydroxide with 0.1 to 5% by weight of low melting or liquid fatty acids or esters and triglycerides of fatty acids.

9 Claims, No Drawings

DUST FREE LITHIUM HYDROXIDE

FIELD OF THE INVENTION

The present invention relates to the preparation of lithium hydroxide which is substantially dust free. More particularly, there is provided lithium hydroxide monohydrate which are crystals dust free and is suitable for producing industrial grease.

BACKGROUND OF THE INVENTION

Lithium hydroxide monohydrate produces a small amount of dust which is always present when being handled or poured. This dust is extremely choking and irritating to humans even in trace amounts. Large amounts of lithium hydroxide monohydrate are used in industrial grease manufacturing and the choking dust has been a major problem in its use.

Lithium hydroxide has also been used in closed-cycle oxygen systems such as the atmosphere which is found in closed places as submarines or in rebreathing appliances which are used in anesthesia or emergency oxygen equipment because it will react with carbon dioxide. In a rebreather system it is necessary that the carbon dioxide be 4% or less than the entire atmosphere inasmuch as a greater amount of carbon dioxide will result in a deleterious effect upon the person in the breathing apparatus. The use of lithium hydroxide has been complicated by the fact that anhydrous lithium hydroxide pellets tend to crumble and create the noxious dust.

U.S. Pat. No. 3,607,040 to Hervert et al has solved the problem of preventing the crumbling and dust formation of pellets by treating anhydrous lithium hydroxide with polyvinyl alcohol and then calcining the resultant mixture to remove any water. The problem with the use of polyvinyl alcohol is that a unitary treatment of lithium hydroxide is not possible for both powder and pellets since polyvinyl alcohol is not used in the production of grease.

U.S. Pat. No. 2,629,652 to Schecter et al discloses forming porous anhydrous, non-dusting granules of lithium hydroxide for use in closed space ventilation systems by pressing lithium hydroxide having a water content of between 40 and 45% under pressure of 18,000 to about 25,000 psi to form a cake, breaking the cake into granules and then heating the granules to a moderate elevated temperature. The dust problem is solved because the fine particles which cause dust are physically separated from the granules.

U.S. Pat. No. 2,846,308 to Baxendale disclosed the treatment of alkali hydroxides, which includes lithium hydroxide, with an ester or an organic acid or an ester or an inorganic acid in liquid form to reduce the hydroscopic properties of the alkali hydroxide for use as photographic developers. About 1 to 15% by weight of a lower alkyl acid ester which is liquid and can generate a volatile alcohol is utilized.

U.S. Pat. No. 5,106,608 to Retsching et al prepares high density ceramics with the use of magnesium oxide in fine powder form which is coated with surface-active materials that are hydrophobic. The coatings include metal soaps, siloxanes, silicones and organic polymers.

It is an object of the invention to provide a method for reducing the dust when handling lithium hydroxide monohydrate powders and granules.

It is another object of the invention to provide a pourable dust-free lithium hydroxide monohydrate powder.

It is yet another object of the invention to provide a pourable lithium hydroxide monohydrate powder which can be directly utilized to produce an industrial grease.

SUMMARY OF THE INVENTION

In accordance with the present invention the above and other objects are accomplished by coating the surface of lithium hydroxide particles and granules with about 0.1 to 5% by weight of a low melting fatty acids and/or liquid esters and triglycerides of fatty acids having 9 or more carbon atoms, preferably 9 to 22 carbon atoms and a melting point below 110 degrees Centigrade.

Advantageously, fumed silica in an amount of about 0.01 to 1% weight percent is added to the composition to enhance flowability.

DESCRIPTION OF THE PREFERRED EMBODIMENTS

In one aspect an embodiment of the present invention lithium hydroxide monohydrate can be made substantially dust free and pourable by the method of adding about 0.1 to 5% by weight of a coating of a low melting or liquid fatty acid or ester or triglyceride of a fatty acid having a melting point less than 100 degrees Centigrade.

Preferably, the coating is formed by admixing the lithium hydroxide at a moderately elevated temperature, preferably above 50 degrees Centigrade or above the melting point of the coating component.

It has been found that heating above the melting point of a solid fatty acid ester caused the ester to melt and coat the surface of the lithium hydroxide. Some partial reaction of the ester is believed to occur to form the corresponding lithium salt of the acid. The reaction is believed to occur as follows:

$$LiOH.H_2O+RCO_2R' \rightarrow RCO_2Li+R'OH+H_2O$$

Usable fatty acids include, among others, capric, lauric, myristic, palmitic, arachidic, behenic, hypogeic and erucic acid. The preferred acids may be saturated or unsaturated and contain 9 to 18 carbon atoms and include myristic acid, stearic acid, oleic acid, linoleic acid and 12-hydroxystearic acid.

Preferred esters include methyl myristate, methyl laureate, methyl oleate, methyl stearate, methyl 12-hydroxylstearate, methyl eicosanate, and the like.

The higher saturated fatty acid esters of mono, di and tribasic alcohols such as butyl, glycol and glycerol stearates and naturally occurring mixtures of esters as found in castor oil, coconut oil, sperm oil, and tallow may be used.

The coating composition can be applied to the particles in any suitable manner such as by dusting, spraying, grinding or dipping. The coating composition can be mixed with the lithium hydroxide in a tumbler, mixer or other similar apparatus. A solid coating agent may also be dissolved in a suitable solvent sprayed over the lithium hydroxide particles and the solvent then removed in a convention manner.

In accordance with another embodiment of the invention 0.01 to 1% by weight of composition of fumed silica can be added to improve pourability.

The following examples are illustrative of the practice of the method of the present invention. It will be understood, however, that it is not to be construed as in any way limitative of the full scope of the invention since various changes can be made, without departing from the spirit of the teaching contained herein, in the light of the guiding principles which have been set forth above. All percentages herein stated are based on weight except where noted.

EXAMPLE 1

About 1.5% by weight of methyl 12-hydroxystearate powder was added with stirring to a container of standard commercial lithium hydroxide monohydrate crystals. The mixture was then heated to 80 degrees Centigrade, mixed again and cooled.

The resulting lithium hydroxide had little or no irritating dust and could be poured with no discomfort or irritation. The product poured readily without sticking or caking.

EXAMPLE 2

Example 1 was repeated with 3.0% by weight of methyl 12-hydroxystearate added to the commercial lithium hydroxide monohydrate crystals. No dust or irritating fumes were detected even when breathing directly in a freshly shaken container of the treated lithium hydroxide monohydrate.

The coated lithium hydroxide monohydrate of the invention can be used in formulating standard industrial greases. About 10 to 20% by weight of lithium hydroxide monohydrate can be admixed with natural or synthetic waxes or greases and/or oils.

EXAMPLE 3

Example 1 was repeated only the resultant mixture was further mixed with 0.5% fumed silica.

The resulting mixture has a slight improvement over the already good pouring properties of the mixture of Example 1.

EXAMPLE 4

50 grams of an isopropanol solution containing 46 grams of castor oil and 4 grams of isopropanol was mixed with 200 grams of commercial lithium hydroxide monohydrate crystals. The mixture was dried by heating while tumbling to remove all of the isopropanol. The resultant lithium hydroxide monohydrate contains 2% coating of castor oil and did not cause any irritation to the nose even after tumbling.

If desired, vacuum may be applied to assist in removal of any isopropanol.

EXAMPLE 5

Preparation of Lithium Grease 4.68 grams of coated dust free lithium hydroxide from Example 1 was added to about 50 grams of water to make up a solution of lithium hydroxide. This solution was added slowly to a stirred mixture of 33.6 grams Cenwax A and Jesco 750 Pale Oil heated at 250° F. over 0.5 hr. The water was allowed to escape without undue foaming. The solution was heated an additional hour to ensure full reaction. The water was removed under vacuum. The lubricant (grease) had a ½ scale 60 stroke penetration of 271. The reaction displayed very little foaming and was easy to control.

In lieu of Cenwax A and Jesco 750 Pale Oil, other waxes and oils which are standard in the industry can be used.

What is claimed is:

1. A method of preparing non-dusting powders and granules of lithium hydroxide which comprises coating the lithium hydroxide powder or granules with about 0.1 to 5% by weight of a low melting or liquid coating agent selected from the group consisting of a fatty acid, a fatty acid ester selected from the group consisting of methyl 12-hydroxystearate, methyl stearate, methyl myristate, methyl oleate and methyl palmitate; and fatty acid triglyceride having a melting point of less than 100 degrees Centigrade and a carbon content of at least 9.

2. The method of claim 1 wherein said lithium hydroxide is powdered lithium hydroxide monohydrate.

3. The method of claim 1 where said coating composition is admixed with said lithium hydroxide at moderately elevated temperature.

4. The method of claim 3 wherein the mixture is heated to at least 80 degrees Centigrade.

5. The method of claim 1 which further includes the step of adding about 0.1 to 1% by weight of fumed silica.

6. A coated powder or granule of lithium hydroxide wherein said coating comprises a coating agent selected from the group consisting of a fatty acid, a fatty acid ester selected from the group consisting of methyl 12-hydroxystearate, methyl stearate, methyl myristate, methyl oleate and methyl palmitate; and a fatty acid triglyceride having a melting point less than 100 degrees Centigrade and a carbon content of at least 9.

7. The coated lithium hydroxide of claim 6 wherein said lithium hydroxide is powdered lithium hydroxide monohydrate.

8. The coated lithium hydroxide monohydrate of claim 6 comprising 0.1 to 1% fumed silica.

9. A grease comprising the lithium hydroxide monohydrate of claim 6.

* * * * *